United States Patent [19]

Lin et al.

[11] Patent Number: 4,575,432

[45] Date of Patent: Mar. 11, 1986

[54] CONDUCTIVE THERMOSETTING COMPOSITIONS AND PROCESS FOR USING SAME

[75] Inventors: Shiow C. Lin, Ellicott City; Craig S. Barber, Columbia, both of Md.

[73] Assignee: W. R. Grace & Co., New York, N.Y.

[21] Appl. No.: 629,085

[22] Filed: Jul. 9, 1984

[51] Int. Cl.[4] ..... H01B 1/06

[52] U.S. Cl. ..... 252/511; 252/512; 252/513; 252/514; 524/439; 524/440; 524/441; 523/457; 523/458; 523/459; 523/468

[58] Field of Search ..... 252/502, 503, 510, 511, 252/506, 512, 513, 514; 523/457–459, 468; 524/439, 440, 441, 495, 496

[56] References Cited

U.S. PATENT DOCUMENTS

| | | | |
|---|---|---|---|
| Re. 30,274 | 5/1980 | Bolon et al. | 252/511 |
| 3,412,043 | 11/1968 | Gilliland | 252/514 |
| 3,609,104 | 9/1971 | Ehrreich et al. | 252/511 |
| 3,746,662 | 7/1973 | Aldeman | 252/513 |
| 3,968,056 | 7/1976 | Bolon et al. | 252/514 |
| 4,410,457 | 10/1983 | Fujimura et al. | 252/512 |

*Primary Examiner*—Josephine L. Barr

*Attorney, Agent, or Firm*—Richard P. Plunkett; William W. McDowell, Jr.

[57] ABSTRACT

This invention is directed to a process and a novel composition for forming a conductive thermoset material which comprises admixing (a) particles of a polymeric material crosslinked to at least its gel point and swellable at its plasticization temperature, (b) at least one liquid reactive plasticizer for (a)

(c) optionally and preferably a curing agent for the reactive plasticizer, and (d) heat or electrically conductive particles, and thereafter heating the admixture for a time sufficient to flux and cure same to obtain a conductive thermoset material. The crosslinking of the thermoplastic polymer can optionally be carried out in a solvent for the polymer. Upon heating, above the plasticization temperature, the liquid reactive plasticizer plasticizes the lightly crosslinked polymer particles. This results in the swelling of the polymer particle, forcing the conductive filler to pack tightly and orderly, thereby increasing the conductivity of the plasticized conductive thermoset after curing.

4 Claims, 1 Drawing Figure

*Concept of Conductive Thermoset*

Concept of Conductive Thermoset

CONDUCTIVE THERMOSETTING COMPOSITIONS AND PROCESS FOR USING SAME

BACKGROUND OF THE INVENTION

1. Field of the Invention

Figure 1:
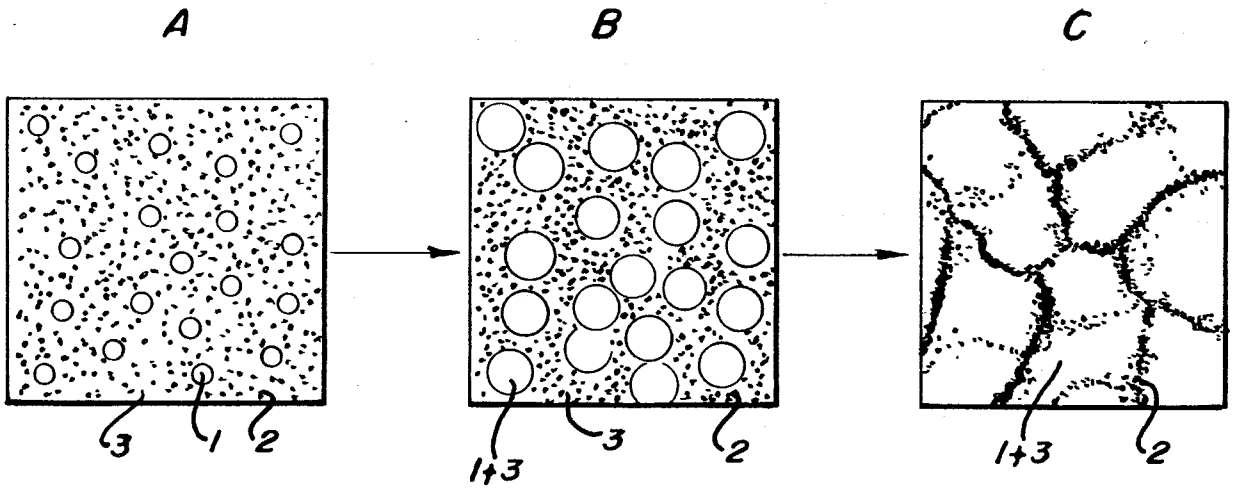

This invention relates to a conductive thermosettable dispersion composition which, on heating at or above the plasticization temperature, rapidly provides a conductive thermoset material with improved conductivity usable as an ink, adhesive, gasket, sealant or in EMI and RF shielding.

The invention also relates to a process for forming a conductive crosslinked bond or seal.

2. Description of the Prior Art

Conductive coatings are known in the art.

U.S. Pat. No. 3,412,043 teaches an electrically conductive resinous composition consisting essentially of silver flake, resinous binder and finally divided inert filler in specified weight ratios. Therein one resinous binder is an epoxy resin system which is cured by the addition of an amine curing agent at slightly elevated temperatures.

U.S. Pat. No. 3,746,662 teaches electrically conductive coatings comprising certain epoxy resins, particles of tough polymer having carboxy, hydroxy, amino or isocyanate substituents which are grafted by the epoxy resin at the interface, finely divided metal particles and a curing agent for the epoxy resin. The curing is obtained by heating the composition at temperatures of 125° C. or higher.

U.S. Pat. No. 3,968,056 teaches a radiation curable ink comprising a particulated electrically conductive metal containing material in combination with an organic resin binder which is converted to a conductive coating on the surface of a substrate by exposure to either actinic or ionizing radiation.

U.S. Pat. No. Re 30,274 teaches a circuit board for activating high voltage flashlamps, said board including a non-conductive, thermoplastic substrate having a patterned electrically conductive coating on one of its surfaces and defining electrical circuitry for the flashlamps, said coating comprising an organic resin matrix curable by UV radiation and a particulated electrically conductive material selected from the group consisting of a particulated electrically conductive metal and a particulated electrically conductive metal containing material, including mixtures thereof with no more than up to about 15% by weight of said particulated electrically conductive material having an aspect ratio of diameter to thickness of a value greater than 20.

U.S. Pat. No. 3,609,104 teaches the use of compressible, non-flowable particles to promote the conductivity of the conductive plastic. The flowable resin is one that chemically bonds to the surface of the non-flowable particles when it is hardened. During hardening, sufficient pressure is applied to distort the non-flowable particles to induce a conductive web from the conductive filler. For this purpose the non-flowable particles must be compressible.

OBJECTS OF THE INVENTION

One object of the instant invention is to produce a novel process and composition. Another object of the instant invention is to produce a conductive dispersion composition which is useful as an ink, shielding, adhesive or sealant. Yet another object of the instant invention is to produce a conductive dispersion composition which on curing has higher conductivity than conventional conductive thermosets. Still another object of the invention is to produce a conductive dispersion composition which on heating to the plasticization temperature acquires handling strength and cures to a conductive thermoset at or above said plasticization temperature. Yet another object of the invention is to produce a conductive, reactive, plasticized thermosetting polymer composition curable to a conductive, thermoset material on exposure to heat. Other objects will become apparent from a reading hereinafter.

DESCRIPTION OF THE INVENTION

This invention relates to a conductive thermosettable dispersion composition comprising an admixture of (a) particles of a polymeric material crosslinked to at least its gel point and swellable at its plasticization temperature, (b) at least one liquid reactive plasticizer for (a), (c) optionally and preferably a thermal curing agent for (b), and (d) particles of a heat or electrical conductive material.

This invention is also directed to a process for forming a conductive thermoset material which comprises partially crosslinking a thermoplastic polymer, e.g., polyvinyl butyral, with a crosslinking agent therefor, e.g., a diisocyanate, to a measurable gel content, comminuting and admixing said crosslinked polymer with (a) a liquid reactive plasticizer therefor, e.g., an epoxy resin, (b) a curing agent for the reactive plasticizer, e.g., dicyandiamide, and (c) heat or electrically conductive particles, e.g., silver flake, and, thereafter, heating the admixture for a time sufficient to plasticize and cure same to obtain a conductive thermoset material. The crosslinking of the thermoplastic polymer can optionally be carried out in a solvent for the polymer.

The conductive, reactive dispersion when plasticized can be used as a gasket, sealant or adhesive.

As used herein, the term "gel point" means the initial point at which a continuous network forms and the polymer is not entirely soluble in suitable solvents.

For a polymer to dissolve in a liquid, it is a thermodynamic requirement that $\Delta F_1$ be negative. $\Delta F_1$, here, is the free energy of dilution, defined below:

$$\Delta \bar{F}_1 = \left(\frac{\partial \Delta Fm}{\partial n_1}\right)_{T,P,n2} = \mu_1 - \mu_1^{\circ} = RT \ln a_1$$

where $n_1$ is moles of solvent; $\Delta Fm$, free energy of mixing; $\mu_l$, chemical potential; and $\mu^{\circ}$ the molar free energy at standard states; and $a_1$, the thermodynamic activity of the solvent.

For flexible linear macromolecules, $\Delta \bar{F}_1$ is given by the very well known Flory-Huggins equation (M. L. Huggins, J. Chem. Phys., 9, 440 (1941); P. J. Flory, ibid. 9, 660 (1941)):

$$\Delta \bar{F}_1 = RT\left[\ln(1 - v_2) + \left(1 - \frac{1}{\gamma}\right) v_2 + x v_2^2\right]$$

where $v_2$ is the volume fraction of the polymer, $\gamma$ is the ratio of molar volumes of polymer and solvent, and x is an interaction parameter that generally varies from −1.0 to slightly over 0.5.

If it is crosslinked, the polymer can only swell and not dissolve, no matter how good a solvent the liquid is for the non-crosslinked polymer. An additional term due to the elastic deformation during swelling must be added to the equation:

$$\Delta\bar{F}_1 = RT\,[\ln(1 - v_2) + v_2 + xv_2^2 + v_2^{\frac{1}{3}}/Mc]$$

where Mc is the molecular weight of the portion of the chain between links.

Therefore, the swelling of a crosslinked polymer depends on the molecular weight between two links, the amount of the solvent, temperature and the interaction between solvent and polymer. Using this solution principle, a conductive thermosetting material having a low conductive filler content can be obtained.

Most linear polymers reduce their melting temperatures after plasticization. Plasticization is a process in which the plasticizer migrates into the three-dimensional lattice of the lightly crosslinked polymer particles resulting in a solvation of the polymer segment by the plasticizer molecules. This reduces the number of points of attraction between segments.

In the thermal curing process, the plasticized linear polymer melts to a liquid when the curing temperature is higher than the melting temperature of the plasticized polymer. To prevent the plasticized polymer from melting, a three-dimensional network must be formed through a crosslinking reaction to chemically bond the mobile polymer molecules at high temperature. Unfortunately, a negative effect on the plasticization process is generated because of the crosslinking reaction. Specifically, when a polymer is highly crosslinked, it becomes very resistant to any solvent and, therefore, loses the advantages realized by swelling. Therefore, to maintain the plasticizability and to resist melt at elevated temperatures, a well controlled crosslinking density for the polymer powder is required.

This invention relates to the preparation of conductive thermosets filled with conductive filler using the swelling of lightly crosslinked polymer particles to increase the conductivity. This invention utilizes the lightly crosslinked polymer particles, dispersed in a thermosetting resin, to force conductive filler to pack tightly and to form a conductive path web after being plasticized at an elevated temperature.

FIG. 1 shows the sequence of the morphological change of the conductive thermosets described herein. In the figure, 1 represents the crosslinked polymer particles, 2 represents the conductive particles and 3 represents the liquid reaction plasticizer. FIG. 1A is a stable dispersion under storage conditions containing a reactive plasticizer or a mixture of reactive plasticizers 3, a crosslinked polymer powder 1 and a conductive filler 2. Upon heating at a curing temperature, the crosslinked polymer particles 1 are swollen through plasticization or solvation by the reactive plasticizer 3 as shown in FIG. 1-B. The volume fraction of polymer particle 1 is increased and, therefore, the packing densitiy of conductive filler 2 is increased as well. When the crosslinked polymer particles 1 containing reactive plasticizer 3 swell to their maximum volume, a conductive web of conductive particles 2 is formed. The conductive web of conductive particles 2 and the size of swollen polymer particles 1 and 3 become permanent after the polymerization or the crosslinking reaction of the reactive plasticizer as shown in FIG. 1C.

The polymer particle will not soften to a liquid state to allow redistribution of conductive filler in a thermosetting resin. Therefore, at any given level of conductive filler content, the conductivity of a thermoset containing a crosslinked polymer powder will have higher conductivity than the conductivity of a pure thermoset as will be shown in examples hereinafter.

This invention relates to the use of swellability of lightly crosslinked polymer powder at an elevated temperature above the plasticization temperature to cause the conductive filler to pack tightly and to arrange orderly and, hence, to increase the conductivity of the conductive thermoset. The reactive plasticizer such as a liquid epoxy does not need to have low viscosity. The essential requirements for the reactive plasticizer are (1) not to swell the crosslinked polymer powder at room temperature, (2) to maintain the viscosity of dispersion, (3) to be able to plasticize the crosslinked polymer powder at an elevated temperature at or above the plasticization point and (4) to be polymerizable or curable. Therefore, any polymerizable or thermosettable resin can be used as the reactive plasticizer when it meets these requirements.

In this invention it is critical that the polymer particles be lightly crosslinked, i.e., at least to its gel point, to prevent the dissolution of the polymer particles in the reactive plasticizers at storage temperature. The polymer powder also has to be swellable by the reactive plasticizer upon heating at or above the plasticization temperature. As used herein, the term "gel point" is the point at which the formation of a continuous three-dimensional network initiates in a system with the result that the gelled material is insoluble in the system. In the instant invention the particles of polymeric material can be crosslinked to a point above the gel point but only to a point where the particle is still swellable by the reactive plasticizer. Additionally, the lightly crosslinked particles of polymeric material can have reactive functional groups such as —COOH, —OH, —$NH_2$ or —NCO present but such groups are not necessary, and higher conductivity for a given amount of conductive fillers is dependent on the solvation of the lightly crosslinked polymer particles by the reactive plasticizer and the plasticizers' subsequent polymerization or curing.

In this invention, a polymer (polyvinyl butyral) was employed to illustrate the concept of using the crosslinking density to control the conductivity of a silver-filled thermoset. The commercially available polyvinyl butyral, Butvar B-72, was first dissolved in a solvent such as dioxane, then reacted with a certain amount of diisocyanate, p-diisocyanatophenyl methane to generate the desired crosslinking and, finally, precipitated by blending the reactant mixture into water:

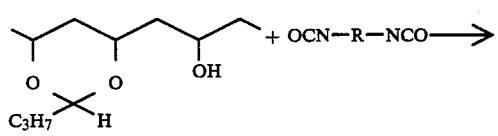

-continued

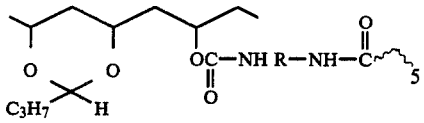

After being pulverized, the dry polymer powder was dispersed in a liquid epoxy resin in the presence of a curing agent, dicyandiamide. The dispersion was then filled with silver flake. After plasticization and curing, the conductivity of the conductive thermoset was characterized.

In the instant invention the crosslinked polymer can be any polymer containing crosslinking linkages. For example, polyolefins such as polyethylene, polypropylene, polyacrylate, polymethacrylate, polyvinyl chloride, polystyrene and others can be lightly crosslinked by free radical generators such as organic peroxides, e.g., benzoyl peroxide and dicumyl peroxide, azo compounds, thiurams, pinacols, and the like. The copolymers prepared from the monomers of the above polymers are also crosslinkable by the same mechanism.

The polymers such as polyvinyl alcohol, polyvinyl butyral, copolymers of hydroxyethyl methacrylate, copolymers of methacrylic acid, copolymers of maleic anhydride and similar polymers containing reactive sites along the polymer backbone or on pendent groups are crosslinkable by condensation and addition reactions such as esterification, urethane formation, amide formation, imide formation, when the crosslinkers are added. Such reactions are well known to those skilled in the art and form no part of the instant invention.

Furthermore, polymers such as polybutadiene, copolymers of butadiene, copolymers of allyl glycidyl ether, unsaturated polyesters and others are vulcanizable or crosslinkable by the addition of vulcanization agents or crosslinkers such as sulfur, dicumyl peroxide, benzoyl peroxide and the like. Such reactions are also known.

The crosslinked polymer powder can also be obtained by directly reacting monomers with polyfunctional monomers. Examples of this type include, but are not limited to, copolymers of divinyl benzene, copolymers of dimethacrylates and copolymers of trimethacrylates.

.Using thermosetting resins such as epoxy, polyisocyanate, silicone resins, polyfunctional acrylate, melamine resins, phenolic resins and melaimides terminated resins, the crosslinking density of thermosets can be obtained by adjusting the average functionality of the reactant mixture and the amount of hardener. Thus, any polymeric material capable of being crosslinked to at least its gel point and swellable by the liquid reactive plasticizer including, but not limited to, the aforestated are all suitable for the preparation of conductive thermosets herein.

In the present invention a reactive plasticizer is a liquid material which can solvate lightly crosslinked polymer powder at a temperature equal to or above the plasticization point and is polymerizable or crosslinkable under polymerization or curing conditions. Therefore, the reactive plasticizer or a mixture of reactive plasticizers in the dispersion will become a plastic, either thermoplastic or thermoset, interpenetrated in the swollen powdered polymer network after the plasticization and polymerization. Reactive plasticizers applicable to this invention include various types of monomers and thermosetting resins. Monomers include, but are not limited to, styrene methacrylates, acrylates, epoxides, diisocyanates, diols, dianhydrides, diamines and dicarboxylic acids which are all suitable as reactive plasticizers. The thermosetting reactive plasticizers include, but are not limited to, epoxy resin, polyfunctional isocyanate, melamine resin, phenolics, polyols, polyamines and the like.

The curing agent employed in the instant invention is dependent upon the type of liquid reactive plasticizer. In certain instances the curing agent is not necessary but can be optionally employed. Examples of this type of liquid reactive plasticizer are acrylic or methacrylic terminated monomers, oligomers or prepolymers which materials are self-polymerizing on heating. However, to increase the reaction rate of the polymerization, free radical generators such as organic peroxides are usually employed. Other liquid reactive plasticizers which are polymerized or crosslinked by free radical generators include, but are not limited to liquid butadiene copolymers and reactive unsaturated olefins. In the instances where free radical generators are used, they are usually present in an amount ranging from 0.001 to 10% by weight of the liquid reactive plasticizer. In other instances such as in the polymerization or crosslinking of epoxy resin with cationic $BF_3$ amine complex or anionic amine initiators, the amount of the initiator ranges from 0.001 to 10% by weight of the liquid reactive plasticizer. In the instance where the liquid reactive plasticizer is an epoxy resin and the initiator is dicyandiamide or an amine adduct, amounts of initiator present range up to the stoichiometric amount necessary to react with the epoxy groups present in the plasticizer. In the instance where a mixture of reactive plasticizers is employed which require different curing agents, a combination of curing agents including those operable for each of the reactive plasticizers should be used. Thus, for example, when an acrylate terminated reactive plasticizer is admixed with an epoxy plasticizer, both an organic peroxide and either a cationic or anionic initiator or dicyandiamide should be combined to insure that both reactive plasticizers are cured.

The electrically conductive material herein can be in the form of particles, spheres, beads, powder, fibers, flakes or mixtures thereof. By "electrically conductive material", as used herein, is meant the electrically conductive material, per se, not including any substrate on which it may be coated. Aside from the noble metals and noble metal coated substrates which can be used as the electrically conductive material herein, the use of other metals such as copper, aluminum, iron, nickel and zinc are also contemplated. Also employable are silver coated glass spheres sometimes referred to as "beads" which have an average diameter of about 6 to 125 microns. These materials are made from glass spheres commonly employed as reflective filler materials and are commercially available. Additionally, glass fibers coated with silver, copper or nickel as shown in French Patent No. 1,531,272 can also be employed. Electrically conductive material used herein also includes carbon black and graphite.

In the instant process the amount of the electrically conductive material needed for conductance is in the range 1 to 80 weight percent of the conductive composition employed, preferably 5–70 weight percent on the same basis with the balance being the thermoset material consisting of the particles of the lightly crosslinked material, reactive plasticizer and curing agent for the plasticizer.

The electrically conductive material employed herein can be used in various sizes depending on its form. For best results, the major dimension of the electrically conductive material should be no greater than about 400 microns. Prefably, the electrically conductive material has a major dimension in the range 10 to 60 microns.

In the thermoset material the amount of the particles of the lightly crosslinked polymeric material can range from 0.0001 to 70%, preferably 0.1 to 30% by weight, with the balance making up to 100% by weight being the liquid reactive plasticizer.

In carrying out the instant invention, the conductive thermosettable dispersion composition is heated to the plasticization temperature of the plasticizing components. This temperature will vary in the range 40° to 250° C. depending on which lightly crosslinked polymeric material and which reactive plasticizer is used. The crosslinking or polymerization reaction of the liquid reactive plasticizer is carried out at a temperature in the range 40° to 250° C. dependent upon the liquid reactive plasticizer and curing agent.

The heating step can be carried out by various means. In simple systems wherein the conductive thermoset material is to be used as an adhesive, the adhesive can be applied by manual means to an adherend, contacted by another adherend and the assembled system heated in a forced air oven until a conductive thermoset bond results. Additionally, electromagnetic heating including induction heating and dielectric heating can also be utilized for faster cures.

The following examples are set forth to explain, but expressly not limit, the instant invention. Unless otherwise noted, all parts and percentages are by weight. Conductivity measurements were made using a two-probe Simpson meter on a cured sample, 50 mm. in length, 3.2 mm. in width and with a thickness measured with a micrometer.

EXAMPLES 1-7

20 g of polyvinyl butyral (Butvar B-72 from Monsanto) was dissolved in 200 ml of dioxane at 40° C. After completion of dissolving, a certain amount of p-diisocyanatophenyl methane (MDI) [TABLE I] was added to generate a lightly crosslinked gel. The gel was then treated with water under vigorous agitation to precipitate the lightly crosslinked polymer. The polymer was filtered and washed with water. After drying, the polymer was ground into powder (particle size $\leqq 100\mu$). The polymer powder could not be melted at a temperature lower than its decomposition point indicating that the polymer is crosslinked to at least its gel point:

TABLE I

| Example No. | 1 | 2 | 3 | 4 | 5 | 6 | 7 |
|---|---|---|---|---|---|---|---|
| Weight Fraction of Polyvinyl Butyral | 100 | 95 | 91 | 83 | 77 | 71 | 67 |
| Weight Fraction of MDI | 0 | 5 | 9 | 17 | 23 | 29 | 33 |

EXAMPLE 8-14

2.2 g of polymer from each of the samples in Examples 1-7 were dispersed in a liquid epoxy mixture containing 15 g of Araldite-6004 and 5 g of Araldite-0500, both commercially available from Ciba-Geigy and 1.5 g of dicyandiamide. To this dispersion was blended 33.3 g of silver flake. After being cured in a 50×3.2 mm. mold at 180° C. for 30 minutes; the conductive thermosets showed conductivities as indicated in TABLE II:

TABLE II

CONDUCTIVITY OF CONDUCTIVE THERMOSETS

| Example No. | 8 | 9 | 10 | 11 | 12 | 13 | 14 |
|---|---|---|---|---|---|---|---|
| Reactive Plastisol from Example No. | 1 | 2 | 3 | 4 | 5 | 6 | 7 |
| Conductivity ($cm^{-1}ohm^{-1}$) | 660 | 2208 | 2036 | 2012 | 1663 | 1576 | 1263 |

We claim:

1. A conductive, thermosettable, reactive plastisol dispersion composition comprising an admixture of
   (a) particles of a polymeric material crosslinked to at least its gell point and swellable at its plasticization temperature,
   (b) at least one liquid, reactive plasticizer for (a), and
   (c) particles of a heat or electrically conductive material, the weight ratio of (a):(b) being 0.0001:99.9999 to 70:30 with (c) being present in an amount in the range 1 to 80% by weight of the total conductive, thermosettable, reactive plastisol dispersion composition.

2. The composition of claim 1, containing in addition a thermal curing agent for (b) in an amount ranging from 0.001 to 10% by weight of (b).

3. The method of making a conductive thermoset article comprising the steps of admixing
   (a) particles of a polymeric material crosslinked to at least its gel point and swellable at its plasticization temperature,
   (b) a liquid reactive plasticizer for (a), and
   (c) particles of a heat or electrically conductive material to form a conductive reactive plastisol composition, the weight ratio of (a):(b) being 0.0001:99.9999 to 70:30 with (c) being present in an amount in the range 1 to 80% by weight of the conductive reactive plastisol composition, and, thereafter, heating the composition for a time sufficient to plasticize and cure same to obtain a conductive thermoset article.

4. The method according to claim 3 wherein the composition contains in addition a thermal curing agent for (b) in an amount ranging from 0.001 to 10% by weight of (b).

* * * * *